US011148028B2

(12) United States Patent
Simmons

(10) Patent No.: US 11,148,028 B2
(45) Date of Patent: Oct. 19, 2021

(54) MODULAR CASCADING GAME AND METHOD

(71) Applicant: Aaron Simmons, Cross Lanes, WV (US)

(72) Inventor: Aaron Simmons, Cross Lanes, WV (US)

( * ) Notice: Subject to any disclaimer, the term of this patent is extended or adjusted under 35 U.S.C. 154(b) by 0 days.

(21) Appl. No.: 16/402,344

(22) Filed: May 3, 2019

(65) Prior Publication Data

US 2020/0346087 A1 Nov. 5, 2020

(51) Int. Cl.
*A63B 63/00* (2006.01)
*A63B 67/06* (2006.01)

(52) U.S. Cl.
CPC ..... *A63B 63/007* (2013.01); *A63B 67/06* (2013.01); *A63B 2063/002* (2013.01)

(58) Field of Classification Search
CPC ..... A63B 63/007; A63B 67/06
See application file for complete search history.

(56) References Cited

U.S. PATENT DOCUMENTS 2,203,240 A * 6/1940 Tipton ..... B65D 21/02 217/8
2,326,859 A * 8/1943 Hoover ..... A63F 7/305 273/396
4,436,779 A * 3/1984 Menconi ..... E01C 13/045 404/41
4,709,929 A * 12/1987 Mills ..... A63B 63/08 273/402
4,927,161 A * 5/1990 Brenneman ..... A63B 67/06 273/402
4,953,786 A * 9/1990 Arsenault ..... A63F 3/00634 238/1 OB
4,961,586 A * 10/1990 Conville ..... A63B 67/06 273/402
5,167,665 A * 12/1992 McKinney ..... A61B 17/0642 606/281
5,329,874 A * 7/1994 Posey ..... A63B 71/0672 116/222
5,823,332 A * 10/1998 Clausen ..... G11B 33/0433 206/307.1
6,041,843 A * 3/2000 Mullet ..... E05D 15/24 160/201
6,086,449 A * 7/2000 Sharp ..... A63H 33/103 446/308

(Continued)

*Primary Examiner* — John E Simms, Jr.
*Assistant Examiner* — Dolores R Collins
(74) *Attorney, Agent, or Firm* — Spilman Thomas & Battle, PLLC; William P. Smith

(57) ABSTRACT

A game apparatus and method for bag toss includes box sections connected end to end to form a cascading arrangement angled from a rear box section to a forward box section towards a playing position. Each box section includes a back plate and a peripheral sidewall projecting outwardly from a front side of the back plate. Each box section is connected with a sidewall of an adjacent box section in sequence. A leg section is attached to a bottom of the sidewall at the box section at one end opposite the section at a base. The leg section supports the game apparatus in an elevated angle inclined towards the forward box section. The method discloses a different scoring value for each box section dependent on the size of the box. The box sections may be nestable within one another for compact storage.

19 Claims, 4 Drawing Sheets

(56) References Cited

U.S. PATENT DOCUMENTS 6,200,026 B1 * 3/2001 Carmichael ..... B63C 11/26 383/16
6,244,598 B1 * 6/2001 Conville ..... A63B 63/00 273/402
6,416,378 B2 * 7/2002 Yurkoski ..... A63H 33/18 446/34
6,652,339 B1 * 11/2003 Carmichael ..... B63B 22/16 441/28
6,712,710 B2 * 3/2004 Pearson ..... A63D 15/00 473/10
7,237,777 B2 * 7/2007 Digges, III ..... A63B 67/06 273/400
7,607,666 B1 * 10/2009 Studier ..... A63B 63/00 116/222
8,578,295 B2 * 11/2013 Chmielewski ..... G06F 3/0482 715/834
8,870,642 B2 * 10/2014 Leupp ..... G07F 17/34 463/20
9,192,841 B1 * 11/2015 Montgomery ..... A63B 69/3623
9,418,518 B2 * 8/2016 Nicely ..... G07F 17/3274
9,636,600 B2 * 5/2017 Rudisill ..... A63H 33/046
9,687,708 B2 * 6/2017 Bennett ..... A63B 63/08
10,258,896 B2 * 4/2019 Ornstein ..... A63H 33/046
10,265,596 B2 * 4/2019 Skala ..... A63B 67/06
2005/0193675 A1 * 9/2005 Smart ..... E01C 5/16 52/578
2006/0255537 A1 * 11/2006 Gandley ..... A63F 7/00 273/126 R
2006/0263572 A1 * 11/2006 Edwards ..... E04H 17/066 428/99
2007/0062131 A1 * 3/2007 Yokubison ..... A63C 19/02 52/177
2009/0295093 A1 * 12/2009 Kiernan ..... A63B 67/06 273/317.2
2010/0176554 A1 * 7/2010 Godwin ..... A63B 67/06 273/338
2011/0215528 A1 * 9/2011 Conville ..... A63B 67/06 273/402
2013/0096609 A1 * 4/2013 Lee ..... A61B 17/06066 606/223
2014/0087825 A1 * 3/2014 Nicely ..... G07F 17/3267 463/20
2014/0374992 A1 * 12/2014 Reile ..... A63B 63/08 273/402

* cited by examiner

MODULAR CASCADING GAME AND METHOD

BACKGROUND

The application generally relates to a modular cascading game and method. The application relates more specifically to a bag tossing game with multiple box sections arranged on consecutive edges to provide cascading surfaces or receptacles for targeting with bags or similar objects suitable for tossing.

Bag toss games in which a board surface has a cutout aperture for receiving an object, such as a bean bag, a ball or a disk, have been used for entertainment at picnics and outdoor games. The board surface is typically inclined towards the player to provide a target at which to throw the object to score points when the object goes through the opening. Typically, these bag toss games are unitary structures that are large and unwieldy for storing, or are not easily re assembled. Also, the board surface is not reconfigurable for varying the difficulty or type of game that can be played.

What is needed is a bag toss game system that can be easily stored and reassembled, and is configurable for multiple game formats. The disclosure satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY

One embodiment relates to a game apparatus for bag toss includes box sections connected end to end to form a cascading arrangement angled from a rear box section to a forward box section towards a playing position. Each box section includes a back plate and a peripheral sidewall projecting outwardly from a front side of the back plate. Each box section is connected with a sidewall of an adjacent box section in sequence. A leg section is attached to a bottom of the sidewall at the box section at one end opposite the section at a base. The leg section supports the game apparatus in an elevated angle inclined towards the forward box section.

Another embodiment relates to a method for playing a bag toss game having cascading box sections for receiving a bag, includes providing a plurality of box sections arranged in a cascading configuration, the boxes connectable end-to-end and inclined in a forward direction facing a player area; assigning a value to each box section of the plurality of box sections for scoring points; providing an article for a player to toss onto a surface of a respective box section; position one or more players adjacent the cascading game sections; throwing the article towards the cascading game sections from the side directly across from a player starting position; throwing the article from a side of the game when tossing the article while not stepping past a game-side forward edge of a base box section of the plurality of box sections; selects a starting position by one player, and beginning the play by opposing player or team by throwing an article first from a starting position; alternating tosses by opposing players; wherein each assigned value corresponding with a level of the game sections is awarded for a base box section as the largest box section assigned one point; a middle section two points as an intermediate sized box section, and end section three points as the smallest box section; awarding points for each article landing on a section.

Still another embodiment relates to a kit comprising parts suitable for assembly into a bag toss game structure. The kit includes an end box section, a base box section and at least one middle box section, and a leg portion; at least one article. The end box section is nestable within the middle box section, and the middle box section nestable within the base box section. The end box section, middle box section and the base box section each has a peripheral rectangular sidewall defining a recess for receiving one of the box sections. Each peripheral sidewall of the respective box sections and the leg portion has recesses for receiving a connector pin. The kit also includes connector pins for insertion into each respective recess.

Certain advantages of the embodiments described herein are as follows:

The disclosed game breaks down easily into components with nestable box sections. The game boxes store within themselves, making it easier to store and transport.

The game provides a novel design that allows the game sections to be flipped upside down, thus making multiple games in set of game pieces.

The game may be played by two opposing players, i.e., singles, or by opposing teams having multiple players.

Alternative exemplary embodiments relate to other features and combinations of features as may be generally recited in the claims.

BRIEF DESCRIPTION OF THE FIGURES

The application will become more fully understood from the following detailed description, taken in conjunction with the accompanying figures, wherein like reference numerals refer to like elements, in which.

DETAILED DESCRIPTION OF THE EXEMPLARY EMBODIMENTS

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
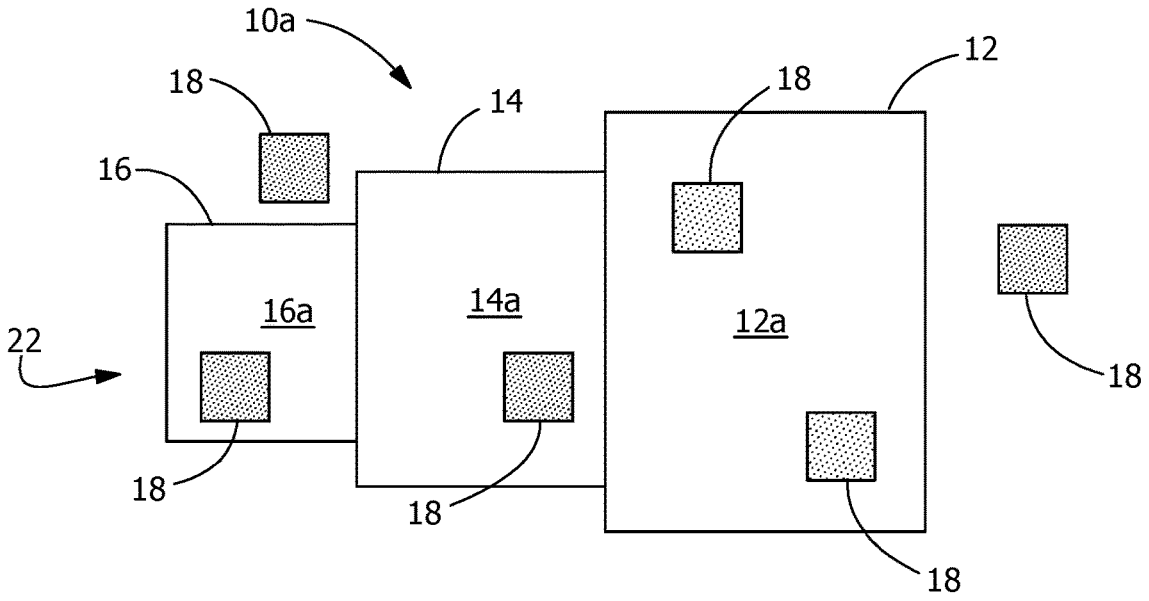
FIG. 1 shows an exemplary embodiment of a bag toss game configuration showing three adjacent boxes open downward.

Referring to FIG. 1, an assembled bag toss game 10*a* is shown with three sections arranged adjacently. Base section box 12, middle section box 14 and end section box 16 are rectangular boxes open on one side, with a back plate 12*a*, 14*a* and 16*a*, disposed opposite the open end. Side wall portions 20 are disposed along the border edges of the respective back plate and project generally perpendicularly to back plates 12*a*, 14*a* and 16*a*.

Figure 3:
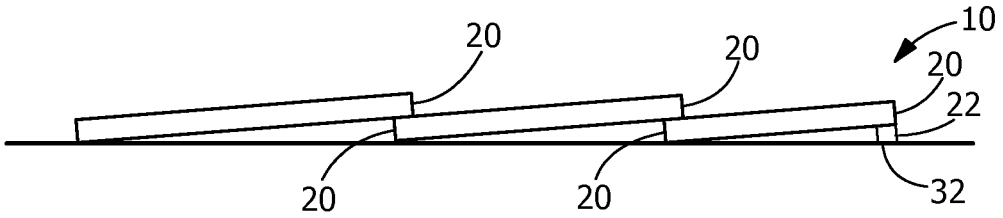
FIG. 3 shows an elevational view of the bag toss game embodiments of FIGS. 1 & 2.

In the embodiment of FIG. 1 boxes 12, 14, 16 are arranged with back plates 12*a*, 14*a* and 16*a* facing up to present a target surface that is generally flat on three cascading tiers. Bags 18 are shown randomly placed on the back plate surfaces as they might be tossed by a player when taking his or her turn at the bag toss. Each box is stacked on one side wall adjacent the next box, i.e., base section 12 on middle section 14, and middle section 14 on end section 16. End section 16 is supported in an elevated angle by leg 22 (FIG. 3). Bags 18 may be bean bags, or other articles suitable for a toss game such as balls, rings or similar items that will not easily bounce out of the box upon contact with the box surface.

When assembled as shown in FIG. 1, bags 18 will land on a section and slide onto a final location on one of back plates 12*a*, 14*a* or 16*a*, or off of the game surface altogether. Points are awarded based on the respective end position of the bags, as described in greater detail below. Since side walls 20 are arranged on edge, to create an inclined surface, side walls 20 catch bags 18 and prevent them from sliding onto the next lower back plate. Thus, if a bag lands on middle section 14, it will be prevented from sliding to the base section 12 by side wall 20. Similarly, if bag 18 lands on end section 16, side wall 20 blocks bag 18 from sliding onto middle section 14.

Each section or box 12, 14 16 is sized to nest within the next adjacent box, i.e., middle section 14 fits inside of base section 12, and end section 16 within middle section 14. Thus, each successive box is smaller than the next, so that they may be stored inside one another when not in use. This arrangement of nestable sized boxes allows for successively smaller back plate surfaces, such that the smaller landing surface provides scoring variations as well. Scoring rules may vary, as discussed below.

Figure 2:
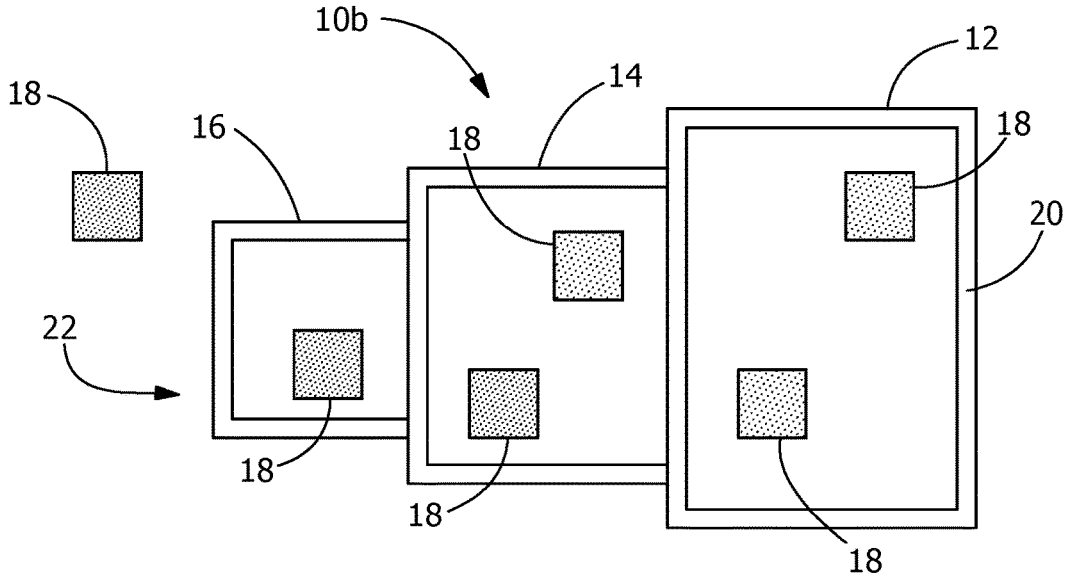
FIG. 2 shows an alternate embodiment of a bag toss game configuration showing three adjacent boxes open upward.

Referring next to FIG. 2, the game 10*b* may be reconfigured using the same boxes 12, 14, 16, with boxes reversed so that back plates 12*a*, 14*a* and 16*a* are on the bottom and sidewalls 20 project upward to create three adjacent receptacles for receiving bags 18. In the embodiment of FIG. 2, boxes 12, 14, 16 are attached at adjacent sidewalls 20, similar to the embodiment of FIG. 1, with boxes facing the opposite direction. Sidewalls 20 provide peripheral barriers that prevent bags 18 from sliding up or down to the next adjacent section. In this embodiment, bags 18 tend to stay where they land, rather than sliding upward or laterally to the next surface, or off of the game surface. This embodiment tends to make it easier to score points, e.g., for younger players that may not have developed accuracy for throwing. While the drawings illustrate embodiments having three box sections, it will be appreciated that more than one middle box section may be inserted between the base box section and the end box section to create more playing surfaces and scoring values, all nestable within another next-sized box for storage.

FIG. 3 shows an elevational view of the bag toss game embodiments of FIGS. 1 & 2. Boxes 12, 14, 16 may be oriented either upward or downward, as discussed above. Sidewalls 20 are supported on adjacent edges of boxes to provide three angled, cascading surfaces for receiving objects 18. Leg 22 supports sidewall 20 of end section 16 to elevate end section 16.

Figure 4:
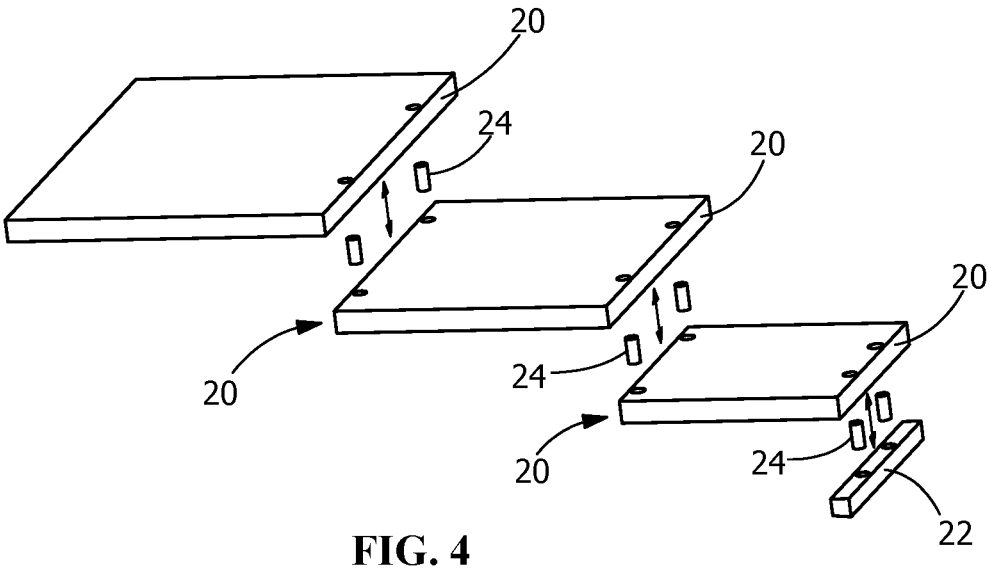
FIG. 4 shows an exploded assembly view of the bag toss game embodiment of FIGS. 1 & 3.

An exploded assembly view of FIG. 3 is shown in FIG. 4, to show the connection means for attaching adjacent sidewalls 20 to assemble the game sections. Pegs 24 are inserted into sleeved apertures 26. Apertures are fitted with sleeved bushings 28 (FIG. 5) to provide alignment and wear resistance for connection parts and sidewalls 20.

Figure 5:
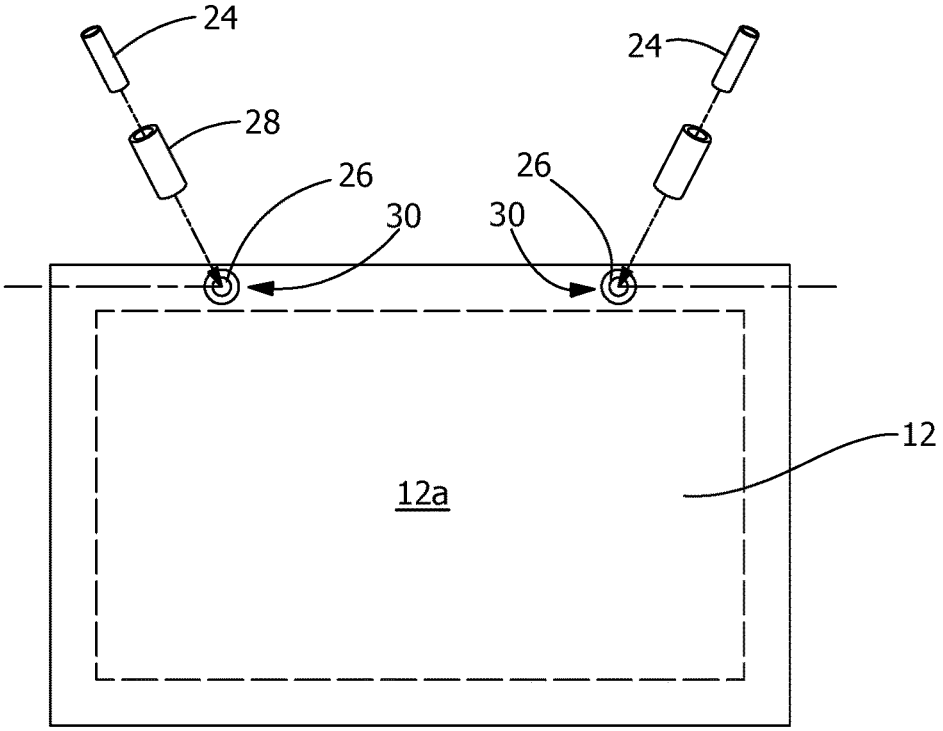
FIG. 5 shows a base section assembly.

FIG. 5 shows a base section 12 and back plate 12*a* assembly. Since base section 12 rests on the ground or other playing surface, only one sidewall need be equipped with a pair of sleeved bushings 28 and apertures 26, for connecting base section 12 with middle section 14. Pegs 24 may be inserted through apertures 26, preferably sized to provide a friction fit when inserted into sleeve bushing 28. Bushings may be glued into drilled holes 30 in sidewalls 20 and back plates 12*a*, 14*a* and 16*a* to permanently position sleeve bushings. Pegs 24 extend through sidewall 20 and into adjacent sidewall 20, sufficient to removably affix adjacent sidewalls into alignment so that one sidewall rests on the other. E.g., pegs may be one and a half times to two times the depth of sidewall 20 to allow at least 50% penetration, up to full penetration of sleeve bushing 28. In an alternate embodiment, opposing sidewalls 20 of base section 12 may each include a pair of sleeved bushings 28 and apertures 26, e.g., to allow reverse order of game sections 12, 16.

Figure 6:
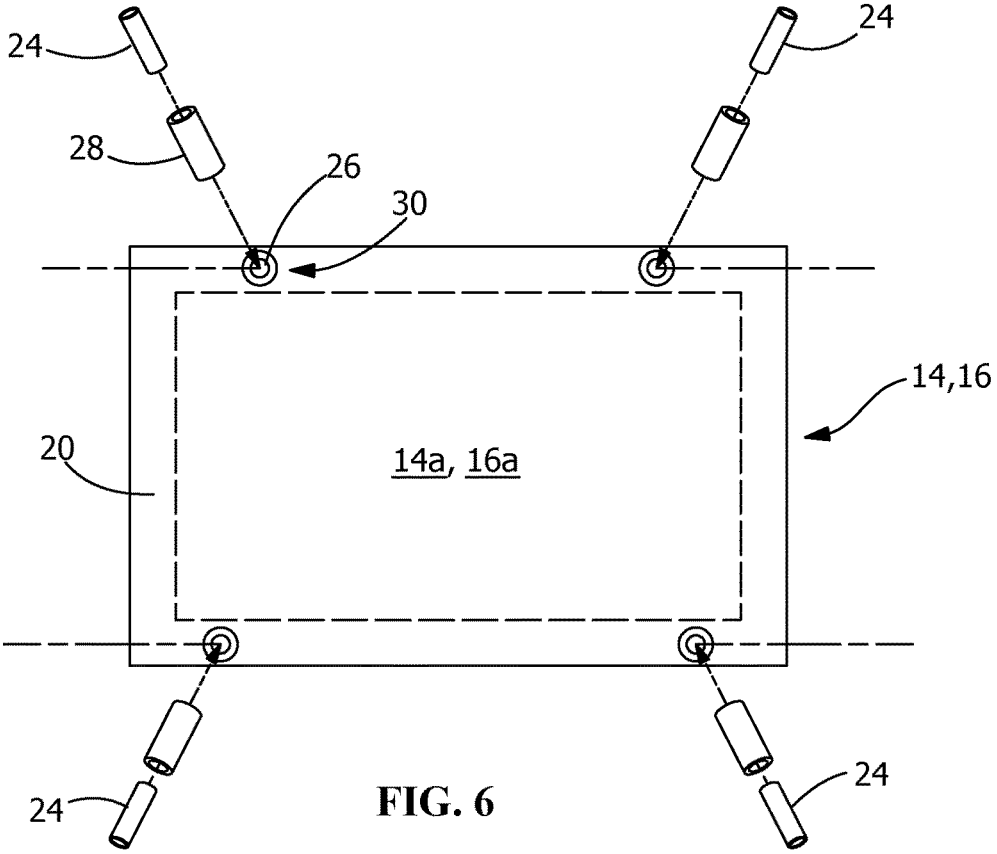
FIG. 6 shows a middle and end section assembly.

FIG. 6 shows a middle section 14 and end section 16 assembly. While middle section 14 and end section 16 differ in size, so that end section fits in middle section, the general arrangement of pegs and apertures is substantially the same. FIG. 6 shows sections 14, 16 from the reverse side of that shown in FIG. 5, to show sidewalls 20 facing upward from back plate 14*a*, 16*a*. A pair of sleeve bushings 28 and apertures 26 are provided on each of two opposing sidewalls 20. Middle section 14 requires connection points between one sidewall 20 with adjacent base section 12, and with end section 16 on the opposing sidewall 20. Similarly, end section requires an additional pair of connection points with leg 22 to elevate sidewall 20 of end section 16.

Figure 7:
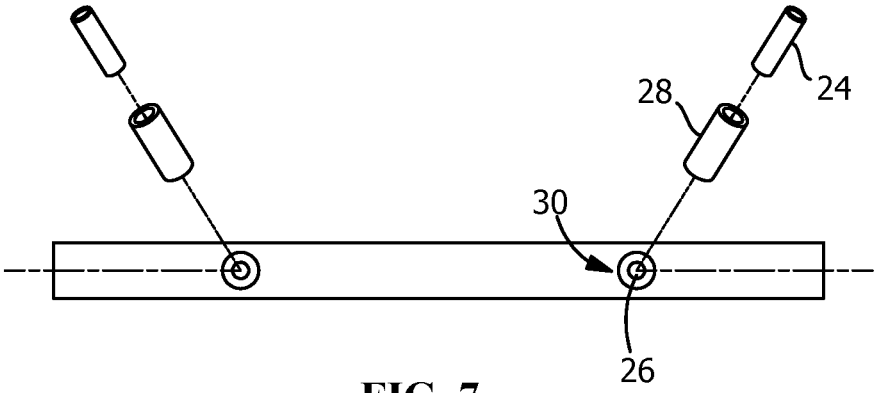
FIG. 7 shows a leg section.
Figure 8:
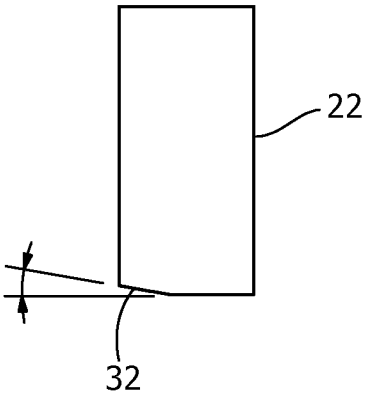
FIG. 8 shows a leg section supporting the game apparatus at an adjustable elevated angle.

FIG. 7 shows a top view of leg section 22. Leg section 22 is preferably the same dimensions as sidewalls 20 in thickness and height, so that the cascaded surfaces are generally oriented at the same angle towards the player when tossing the bags. In alternate embodiments, leg section 22 may vary in height with respect to sidewalls to create a steeper or slighter angle towards the player(s). Leg section 22 includes a pair of sleeved bushings 28 and apertures 26 for receiving a peg 24, so as to join sidewall 20 of end section 16 when assembling game 10. In an embodiment, leg section 22 may include a 10 degree chamfer 32 (FIG. 8) at a forward corner for resting at a complementary angle with box sections 12, 14, 16.

An embodiment of an exemplary game 10 and rules for use with the aforementioned game elements is described as follows.

Game 10 breaks down easily into components with nestable box sections 12, 14, 16. Game 19 stores within itself, making it easier to store and transport. Game 10 provides a novel design that allows the game to be flipped upside down, thus making two games in one.

The game may be played by two opposing players (singles) or by opposing teams.

In an exemplary embodiment, multiple individuals, or players, position themselves adjacent respective opposing game sections, or target panels. Each player throws towards a game assembly 10 from the side directly across from their starting position. Alternately, when the game is played with teams, e.g., usually teams formed of two players each, teammates position themselves directly across from each other, one beside each opposing target panel. Players must throw from the side of a game assembly 10, when tossing their respective bags, while not stepping past the game-side forward edge of base section 12. One player/team selects a starting position, and the other player/team begins by throwing bags first from its starting position. Opposing players alternate tosses. Each level of the game sections is assigned a different score value, e.g., base section, which is the largest box section, may be assigned one point; middle section two points, and end section, or smallest section, three points. Points are awarded for each bag landing on a section, respectively. In an embodiment, six bags may be tossed per player. The team that received the most recent points goes first on the next series of tosses.

The game may be broken down and stored as follows for each target panel. First, by removing the base, or largest section from the rest of the game and placing the base section upside down on the ground; removing pegs 20 from the middle section 14 and setting pegs aside; removing the middle section and placing middle section upside down, while nesting it inside the largest section; removing the respective pegs 20 from the end section, or smallest section; placing all four pegs and three bean bags in the middle section of the target panel; folding legs 22 into the smallest section 16; and placing the smallest section inside the middle section, with back plate 16*a* facing up. In an embodiment, Bean bags may be made from duck canvas and each bag filled with approximately two cups of corn feed. The finished bags 18 should be 6"×6" square pouches and weigh between 14 and 16 ounces. Alternately, other objects may be used for tossing at the assembled game 10, such as rubber or tennis balls, discs or similar objects. Bags 18 may be sized larger or smaller if desired.

The game may be played by two opposing players (singles) or by one or more opposing teams, according to the following rules, in an exemplary embodiment. Singles players position themselves beside their respective opposing target panels, player throws from the side directly across from their starting side.

When the game is played with teams (usually teams of two), teammates position themselves directly across from each other, one beside each opposing target panel. Players must throw from beside, without stepping forward of the front panel of the game. A player receives a "foul" by stepping past the game-side front of the panel when tossing a bag. The player or team that did not choose their starting position throws first. Opposing players alternate tosses. Scoring points are determined after each player tosses all three bags. A bag landing on the largest section of the target panel scores one (1) point. A bag landing on the middle section of the target panel scores two (2) points. A bag landing on the smallest section scores three (3) points.

After each singles player or team counts all of their scored points, the player/team with the most points wins that series of tosses and adds the difference to their accumulating point total. For example, if Player/Team-1 gets 7 points and Player/Team-2 gets 3 points, then Player/Team-1 adds 4 points to their accumulating total.

The team that received the most recent points goes first on the next series of tosses. The winning team must get exactly 21 points. If a player/team scores more than 21 points, then that player/team's score goes back to 15 points.

The player/team that exceeds 21 points throws first on the next series of tosses.

In one alternate embodiment, a player/team is "skunked", i.e., loses the game, when their score is zero (0) against their opponent's thirteen (13) points. Players are to switch sides between games, as the flight of the bags may be affected by the wind direction.

Also disclosed is a kit including disassembled parts, suitable for assembling game structure 10 into the arrangement described above. The kit includes A section of two by four wood board, plywood, 1½" and 3" wood screws, ½" CPVC Pipe, ¼" wood dowel for pegs, preferably oak, and wood glue for connecting the parts. A base section or box 12 measuring 25"×19¾", a middle section 14 measuring 21"×15¼", and an end section 16 measuring 17"×11½". Leg 22 is a two by four board cut to length of 13¾". CPVC pipe sections measuring ½"×1½", and pegs measuring ¼" round and 2½" long. It should be noted that the size of the box sections 12, 14, 16 may vary in rectangular dimensions, respectively, provided that the boxes fit into each other as shown. Also, various geometries may be used instead of rectangular boxes, e.g., circular, oblong, parallelogram, rhomboid, trapezoid or other geometric shapes, within the scope of the appended claims, provide the shapes are storable within one another.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the modular cascading game as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

It should be noted that although the figures herein may show a specific order of method steps, it is understood that the order of these steps may differ from what is depicted.

What is claimed is:

1. A game apparatus for bag toss comprising:

a plurality of box sections connected end to end to form a cascading arrangement angled from a rear box section to a forward box section towards a playing position;

each of the box sections comprising a back plate and a peripheral sidewall projecting outwardly from a front side of the back plate, each box section of the plurality of box sections connected with a sidewall of an adjacent box section in sequence; and a leg section attached to a bottom of the sidewall at the box section at one end opposite the section at a base, the leg section supporting the game apparatus in an elevated angle inclined towards the forward box section;

the incline of the game apparatus being arranged such that an article landing on any back plate of the respective box section will be disposed forward and come to rest adjacent a front sidewall of the respective box section, the front sidewall preventing the article from sliding into the adjacent box section; and wherein the plurality of box sections are reversibly configurable in a first game arrangement comprising respective box section plates facing upward to present a target surface that is generally flat on three cascading tiers to provide a plurality of adjacent flat surfaces for receiving an article tossed by a player; and in a second game arrangement comprising an open end facing upward, and the sidewalls of the respective box sections are arranged on edge to form an inclined surface; the side walls projecting from the back plate to prevent articles from sliding onto the next lower back plate.

2. The game apparatus of claim 1, wherein the plurality of box sections include a base box section and an end box section, each box section comprising a rectangular shaped box open on one side, and a back plate disposed opposite the open side; the sidewalls disposed along the respective back plate along an edge and configured to project generally perpendicularly to the back plate.

3. The game apparatus of claim 1, wherein the plurality of box sections further comprising at least one middle box section disposed between the end box section and the base box section; the middle box section comprising a front sidewall connected to the sidewall of the base section, and at a rear sidewall to the end section forward sidewall.

4. The game apparatus of claim 1, further comprising each of the box sections arranged with the respective box section plates facing upward to present a target surface that is generally flat on three cascading tiers to provide a plurality of adjacent flat surfaces for receiving an article tossed by a player.

5. The game apparatus of claim 1, wherein: each respective back plate of the plurality of box sections being assigned a different value for playing a game, in which points corresponding to the values being awarded based on the respective box section that the article comes to rest.

6. The game apparatus of claim 1, wherein the box sections are arranged with the open end facing upward, and the sidewalls of the respective box sections are arranged on edge to form an inclined surface; the side walls projecting from the back plate to prevent articles from sliding onto the next lower back plate.

7. The game apparatus of claim 1, wherein an article that lands on a middle box section disposed between the rear section and the forward section, is blocked from sliding to the base box section by the middle box section side wall; and wherein an article that lands on the end box section is blocked by the end box section side wall from sliding onto the middle box section.

8. The game apparatus of claim 1, wherein each box section is progressively smaller such that end box section nestable entirely within the middle box section sidewall and the middle box section nestable entirely within the base box section, for storing in a compact area when disassembled.

9. The game apparatus of claim 1, wherein the connection portions for attaching sidewalls of adjacent box sections, the connection portions comprising a plurality of pegs and a plurality of apertures for receiving pegs therethrough in friction fit.

10. The game apparatus of claim 1, wherein each aperture of the plurality of apertures includes bushings for alignment of sidewalls.

11. The game apparatus of claim 1, wherein a base section and back plate configured for the base section to rest on the playing surface, the base section having at least one sidewall comprising a pair of apertures, each of the apertures comprising a sleeved bushing for receiving a peg to connect base section with a corresponding aperture and bushing of a next adjacent box section; wherein the pegs are inserted through the apertures, the pegs extending through the base section sidewall and into adjacent sidewall to removably affix adjacent sidewalls into alignment so that the base section sidewall rests on the adjacent box section sidewall.

12. The game apparatus of claim 1, wherein opposing sidewalls of the base box section each include a pair of sleeved bushings to allow reversing the order of box sections when playing the game.

13. The game apparatus of claim 1, wherein the middle section comprising a pair of sleeve bushings and apertures on opposing sidewalls for connection between one sidewall with base box section, and with end box section on the opposing middle box section sidewall.

14. The game apparatus of claim 1, wherein end box section comprises a pair of connection points on the sidewall adjacent the base plate to attach the leg section and elevate the rear sidewall of the end box section.

15. A method for playing a bag toss game having cascading box sections for receiving a bag, comprising:

providing a plurality of box sections arranged in a cascading configuration, the boxes connectable end-to-end and inclined in a forward direction facing a player area;

configuring the plurality of box sections in a first game arrangement comprising respective box section plates facing upward to present a target surface that is generally flat on three cascading tiers to provide a plurality of adjacent flat surfaces for receiving an article tossed by a player;

reversing the plurality of boxes to provide a second game arrangement comprising an open end facing upward, and the sidewalls of the respective box sections are arranged on edge to form an inclined surface; the side walls projecting from the back plate to prevent articles from sliding onto the next lower back plate;

assigning a value to each box section of the plurality of box sections for scoring points;

providing an article for a player to toss onto a surface of a respective box section;

position one or more players adjacent the cascading game sections;

throwing the article towards the cascading game sections from the side directly across from a player starting position;

throwing the article from a side of the game when tossing the article while not stepping past a game-side forward edge of a base box section of the plurality of box sections; selects a starting position by one player, and beginning the play by opposing player or team by throwing an article first from a starting position; alternating tosses by opposing players;

wherein each assigned value corresponding with a level of the game sections is awarded for a base box section as the largest box section assigned one point; a middle section two points as an intermediate sized box section, and end section three points as the smallest box section;

awarding points for each article landing on a section.

16. The method of claim 15, further comprising providing from one bag to six bags as the article to be tossed, and up to six bags may be tossed per player; wherein a team that receives the most points begins play first on a next series of tosses.

17. A kit comprising parts suitable for assembly into a bag toss game structure comprising:

an end box section, a base box section and at least one middle box section, and a leg portion; at least one article wherein the end box section nestable within the at least one middle box section, and the at least one middle box section nestable within the base box section; the end box section, the at least one middle box section and the base box section including a peripheral rectangular sidewall defining a recess for receiving one of the box sections; each peripheral sidewall of the respective box sections and the leg portion including a plurality of recesses for receiving a connector pin; the kit further comprising the connector pins for insertion into each respective recess; and wherein the box sections are reversibly configurable in a first game arrangement comprising respective box section plates facing upward to present a target surface that is generally flat on three cascading tiers to provide a plurality of adjacent flat surfaces for receiving an article tossed by a player; and in a second game arrangement comprising an open end facing upward, and the sidewalls of the respective box sections are arranged on edge to form an inclined surface; the side walls projecting from the back plate to prevent articles from sliding onto the next lower back plate.

18. The kit of claim 17, further comprising: a section of two by four wood board, plywood, at least one 1½" wood screw and at least one 3" wood screw, a section of ½" CPVC pipe, a section of ¼" wood dowel for pegs; the base section box measuring 25"×19¾", the middle section box measuring 21"×15¼", and the end section measuring 17"×11½"; the leg portion comprising a two by four board about 13¾" in length.

19. The kit of claim 17, wherein the size of the end, base and middle box sections vary having a geometry, respectively, and wherein the boxes are nestable with one another successively; the geometry selected from one of rectangular, circular, oblong, parallelogram, rhomboid and trapezoid.

* * * * *